US006842947B2

(12) United States Patent
Gujer

(10) Patent No.: US 6,842,947 B2
(45) Date of Patent: Jan. 18, 2005

(54) FLAT END HEAD MADE OF POLYMER MATERIAL

(75) Inventor: Peter Gujer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/410,521

(22) Filed: Apr. 9, 2003

(65) Prior Publication Data

US 2003/0221293 A1 Dec. 4, 2003

(30) Foreign Application Priority Data

Apr. 11, 2002 (DE) ..... 102 16 067

(51) Int. Cl.[7] ..... D01G 15/84
(52) U.S. Cl. ..... 19/114; 19/98
(58) Field of Search ..... 19/102, 103, 104, 19/110, 111, 113, 98, 114; 2/16, 20, 158, 159, 160, 161.3, 161.6, 161.8, 162, 167, 169; 451/523, 527

(56) References Cited

U.S. PATENT DOCUMENTS

| | | | | | |
|---|---|---|---|---|---|
| 3,643,386 | A | * | 2/1972 | Grzyll | 451/523 |
| 3,748,792 | A | * | 7/1973 | Lamb | 451/523 |
| 3,789,555 | A | * | 2/1974 | Means | 451/523 |
| 3,885,249 | A | * | 5/1975 | De Brabander | 15/227 |
| 4,038,787 | A | * | 8/1977 | Bianchi | 451/523 |
| 4,300,266 | A | | 11/1981 | Grimshaw et al. | |
| 4,497,073 | A | * | 2/1985 | Deutsch | 2/20 |
| 4,827,573 | A | | 5/1989 | Kuehl | |
| 4,955,111 | A | | 9/1990 | Jagst | |
| 4,987,647 | A | * | 1/1991 | von Gehlen | 19/111 |
| 5,134,746 | A | * | 8/1992 | William | 15/227 |
| 5,134,809 | A | * | 8/1992 | Morton et al. | 451/523 |
| 5,230,135 | A | * | 7/1993 | Kuehl | 29/458 |
| 5,542,154 | A | | 8/1996 | Demuth et al. | |
| 5,642,527 | A | * | 7/1997 | Savage | 2/161.8 |
| 5,885,148 | A | * | 3/1999 | Vargas et al. | 451/523 |
| 6,269,522 | B1 | * | 8/2001 | Graf et al. | 19/113 |

FOREIGN PATENT DOCUMENTS

| | | | | |
|---|---|---|---|---|
| DE | 28 25 525 | * | 1/1979 | A41D/19/00 |
| DE | 19834893 A1 | | 2/2000 | |
| EP | 0620296 B1 | | 10/1994 | |
| GB | 2078091 | * | 1/1982 | A41D/19/00 |
| GB | 2347069 | * | 8/2000 | A41D/19/00 |

* cited by examiner

*Primary Examiner*—Gary L. Welch
(74) *Attorney, Agent, or Firm*—Dority & Manning, P.A.

(57) ABSTRACT

A flat end head with a mounting section for the flat rod and at least one sliding surface for progressive movement on a sliding guide of a card is made of a polymer material. The polymer material may be fiber-reinforced. Further, the polymer material may include a solid lubricant. The sliding guide may also be made of a polymer material. An apparatus for replacing a flat end head on a flat rod is also provided.

34 Claims, 4 Drawing Sheets

FLAT END HEAD MADE OF POLYMER MATERIAL

BACKGROUND OF THE INVENTION

The present invention relates to a flat end head of a flat rod for a revolving flat of a card.

In cards of the respective category a multiplicity of flat rods are led on a sliding guide over the card drum. This arrangement is also called revolving flats. They are connected by an endless component, for example a belt or a chain, and are moved by a drive means. Both the flat rods and the cylinder have a clothing with clothing points, for example, fine needles or in the form of a saw tooth. The clothing on both the flat rods and the cylinder reciprocally work with one another for the cleaning and the aligning of the fibers. In order to achieve a carding result, it is particularly important that the distances between the flat rods and the card cylinder, and/or the distance of the clothing points, are maintained accurately. The carding gap between the two clothings is a few tenths of a millimeter at the most.

The flat rods comprise a flat end head each at their ends. The flat end head has a mounting section for the mounting with the end of the flat rod and at least one sliding surface. Usually the flat end head furthermore has a device, for example, a recess, in order to attach the endless component. An example of such a combination, consisting of the flat rod, an endless component, and the flat end head is disclosed in the patent specification EP 0 627 507 B1.

The sliding surfaces of the flat end heads are at the same time the surfaces with which the entire flat rod rests on the sliding guides. They have furthermore the function of cooperating with the sliding guide, and providing a low friction and dimensionally accurate running of the flat rod. It is, therefore, important that the flat end head and the sliding guide are co-ordinated accurately with each other, so that the distance between the flat rod and the cylinder (between their respective clothing points) can be held within a predetermined range of tolerance.

Due to the sliding movement of the flat end head on the sliding guide, the sliding guide and/or the sliding surface of the flat end head are subjected to wear. The wear of the sliding guide or the sliding surface of the flat end heads is essentially a question of the applied material combination. The wear can also be reduced and/or minimized by the application of lubrication devices (e.g. oil lubrication).

The sliding guide on the card is traditionally made of cast iron. The latest state of the art, for example according to EP 620 296 or EP 361 219, discloses sliding guides with sliding strips made of polymer material. The latter disclosure does not disclose which type of material is being used for the flat end head. EP 620 296 discloses cast iron or stable metal for the flat end heads. Beside these materials, furthermore, solid steel (U.S. Pat. No. 4,827,573) or aluminium/aluminium alloy (U.S. Pat. No. 4,300,266) are specified for the manufacturing of the flat end heads. In these patent specifications, however, no specifications are given concerning the material for the sliding guide.

In order to increase the gliding ability of these flat end heads, according to the state of the art, guiding shoes are also being provided which are attached to the flat end head. Patent specification U.S. Pat. No. 4,300,266, for example, shows a flat shoe which, if necessary, is interchangeable. However, this flat shoe is pushed onto the flat head by shifting it in an axial direction and by attaching it by means of clips. A disadvantage of this solution is the extraordinary effort required during replacement of the flat shoes. The play in the direction perpendicular to the longitudinal axis of the flat rod, which is necessary for sliding the flat shoe onto the flat rod, is disadvantageous for the accurate allocation of the flat rod with respect to the cylinder.

Other examples of guiding shoes are disclosed in the U.S. Pat. No. 4,300,266, wherein as material for the guiding shoe phosphorus/bronze or a polymer material, for example MoS2/Nylon or a combination containing PTFE, are being suggested. DE 198 34 893 discloses a polymer material guiding shoe, for example, made of polyamide material.

In practice guiding shoes are also glued. Not only are the additional expenditures to replace the old guiding shoe and to remove the adhesive material disadvantageous, but also, when adhering the new shoe, the adhesive material can smear, which can substantially impair the flat rod in its function. Only a very precise job can prevent these irregularities, this precision requires, however, a substantial additional extra effort.

In summary, for the present flat-rods, flat-end-heads are applied which are made of steel or cast iron and which are partially provided with guiding shoes. Although this combination is sufficient for the requirements of the flat rods, it is still disadvantageous for the manufacturing. Depending on the type of frame, approximately 100 flat rods are used on a machine. Each additional component on a complete flat rod increases the production costs.

OBJECTS AND SUMMARY OF THE INVENTION

It is, therefore, a principle object of the present invention to optimize the flat end head by considering the material combination used in the flat end head and production costs involved. Additional objects and advantages of this invention will be set forth in part in the following description, or may be obvious from the description, or may be learned through practice of the invention.

One embodiment according to the invention provides a one-piece flat end head made of a polymer material.

Internal research revealed that with the material combination of cast iron/polymer material similar wear mechanisms take place as in a material combination steel/polymer.

For the solution according to the invention, a sliding guide made of cast iron or steel is preferred. However sliding guides made entirely or partially of a polymer material could also serve as sliding partners for a flat end head made of a polymer material, as is suggested in this invention.

A flat end head includes multiple sections. The first section is responsible for the mounting with the flat rod. The second section consists of the actual head which rests on the sliding guide and which comprises additional respective sliding surfaces. One of these sections could additionally be provided with a device for the mounting of an endless belt component.

As basis for the flat end head, the following polymer material is preferably used:

- a material from the group of polyamides, for example polyamide 66;
- a material from the group of the polyoxymethylene (POM), the homo-polymers (POM-H) and co-polymers (POM-C), examples of which are Delrin® or Hostaform®;
- a material from the group of the terephthalates, preferably polyethylene terephthalate (PETP) or polybutylene-terephthalate (PBTP);

a material from the group of the polyetheretherketones (PEEK); and a material from the group of the polyimides (PI), for example polyamidimide (PAI).

A further embodiment according to the invention provides fiber reinforcement for the polymer material. Thus, the strength of the flat end head can be increased. The contact point between the mounting section and the actual head is subjected to several forces during the operation of the revolving flat. The flat rod is only carried by its flat end heads. In order to ensure an accurate dimensional guidance, these flat end heads may not deflect. Additionally, they are also subjected to torsion loads by the lateral movement of the flat rods by means of the drive component. A torsion of the material would likewise negatively affect the dimensionally accurate guidance.

An additional aspect is that the entire flat end head is made of a material which is subjected to wear. The selected synthetic material can thereby penetrate to the surface of the sliding surface. Abrasive fibers could then cause an unwanted abrasion on the sliding guide, according to the invention, preferably carbon fibers (for example PAN-Fibre®) or aramid fibers (polyamidimide fibers, for example Kevlar®) are used. A mixture of both fibers could also be used. Above all, since the aramid fibers have a more favorable wear characteristic in relation to the sliding partners and the carbon fibers achieve a better strength. Through a combination, an optimal solution will result.

For the required strength, a total fiber portion of 5–60 percent weight, preferably 30–50 percent weight is required. If not stated otherwise, the weight percentage, in the entire disclosure, is always calculated with respect to the end weight. In the case of a mixture of aramid fibers and carbon fibers, an aramid fiber portion of a minimum of 10 percent weight is preferred.

A further solution according to the invention is a flat end head made of a polymer material with a solid lubricant additive. Tests showed that not every combination that is made of a basis polymer material and a solid lubricant on cast iron show an optimal gliding ability and lubrication characteristic. Preferred combinations are shown in table 1, wherein in column 1 specifies the preferred groups of basis polymer materials and column 2 specifies the preferred solid lubricants which proved to be most suitable for the function of the flat end.

In order to attain the desired sliding characteristics 1–15 percent weight of solid lubricants are required, preferably 5–12 percent weight; most preferably 8–11 percent weight. With molybdenum disulphide (MoS2) and a polysiloxan, lower quantities of solid lubricants are already sufficient, preferable for these 2 solid lubricants are 1–6 percent weight, preferably 1–3 percent weight, for example 2 percent weight.

TABLE 1

Preferred combinations of basis polymer material and solid lubricant

| Basis polymer material | | Lubricant |
|---|---|---|
| I. | Polyamide PA | a. PTFE (fiber or powder)<br>b. Polysiloxan (Silicon)<br>c. Graphite<br>d. Polyethylene<br>e. Molybdenum disulphide (MoS2) |
| II. | Polyoxymethylene POM | a. Polysiloxan (Silicon)<br>b. PTFE (fiber or powder) |
| III. | Terephthalate | a. PTFE (powder or fiber) |

TABLE 1-continued

Preferred combinations of basis polymer material and solid lubricant

| Basis polymer material | | Lubricant |
|---|---|---|
| IV. | Polyetheretherketone PEEK | a. PTFE (powder or fiber) |
| V. | Polyimide PI | a. PTFE (powder or fiber)<br>b. Graphite<br>c. MoS2 |

The flat end heads can be manufactured by way of injection moulding technique.

For the even application of a complete set of flat rods on the cylinder, the flat rods and flat end heads are often treated after they have been assembled. With the selected combinations of the materials, milling or grinding of the sliding surface is possible.

By way of the Figures, the invention is described in more detail.

DETAILED DESCRIPTION

Reference will now be made in detail to the presently preferred embodiments of the invention, one or more examples of which are shown in the Figures. Each example is provided to explain the invention, and not as a limitation to the invention. In fact, features illustrated or described as part of one embodiment can be used with another embodiment to yield still a further embodiment. It is intended that the present invention cover such modifications and variations.

Figure 1:
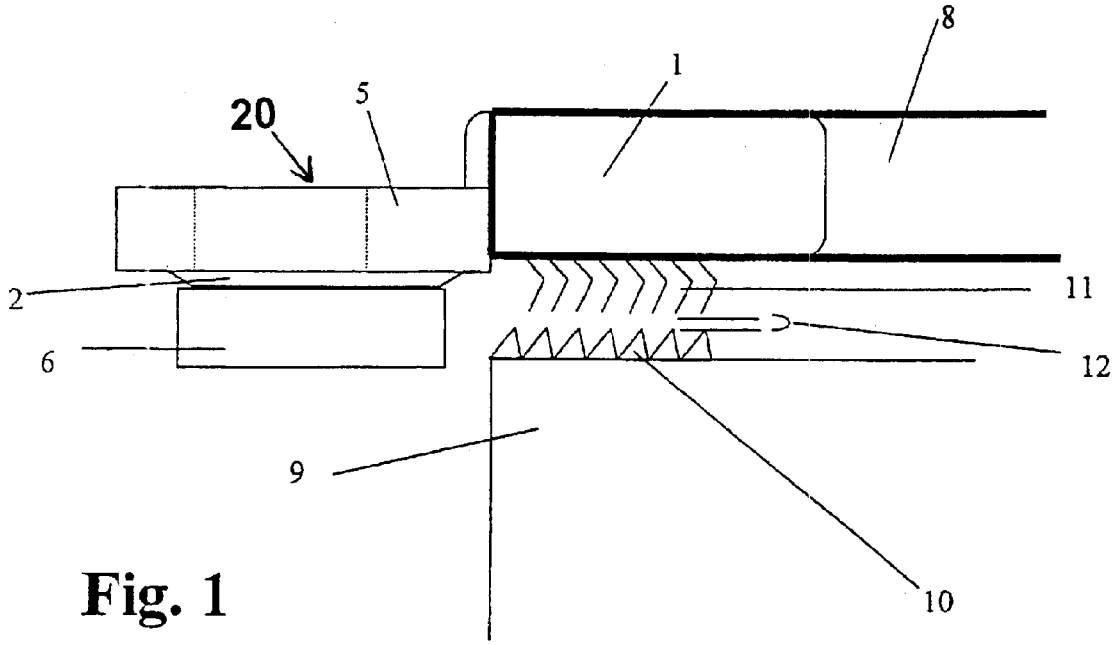
FIG. 1 shows a schematic illustration of the flat end head in the card.
Figure 2:
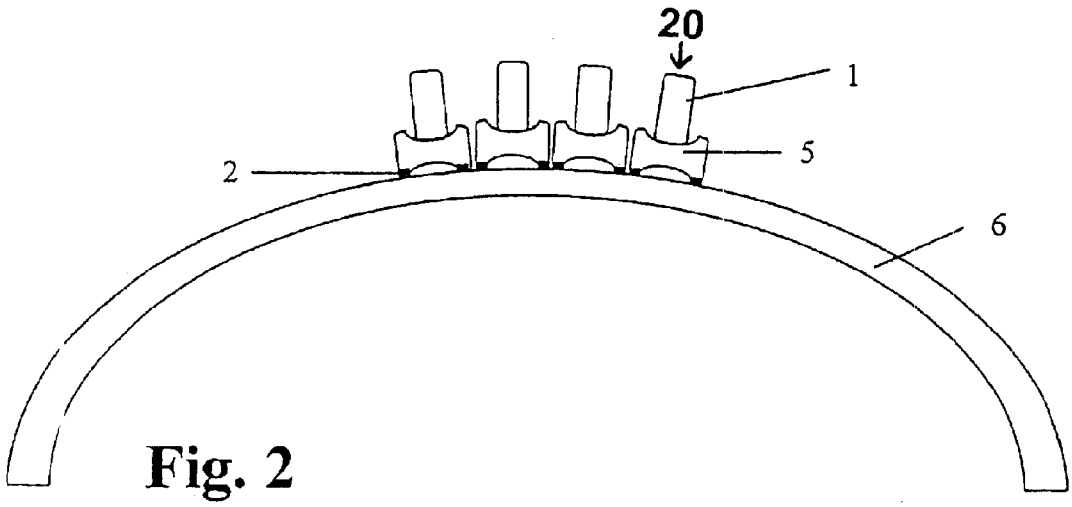
FIG. 2 shows a schematic illustration of the flat end head on the sliding guide.

FIG. 1 shows how a flat end head (20) co-operates with a flat rod (8) and the sliding guide on a card. The flat rod (8) is formed by a hollow profile, a part of which serves as mounting means for the flat end head (20). The flat end head (20) is slid into the flat rod (8) up to the stop. With the sliding surface (2) the flat end head (20), together with the flat rod (8), rests on the sliding guide (6). (In FIG. 2, this is shown from the side of the cylinder and it can clearly be recognized that the sliding guide (6), in the form of an arc, follows the curvature of the cylinder.) The carding gap (12) is the distance between the clothing (11) of the flat rod and the clothing (10) of the cylinder (9). This is to be dimensionally accurate.

Figure 3:
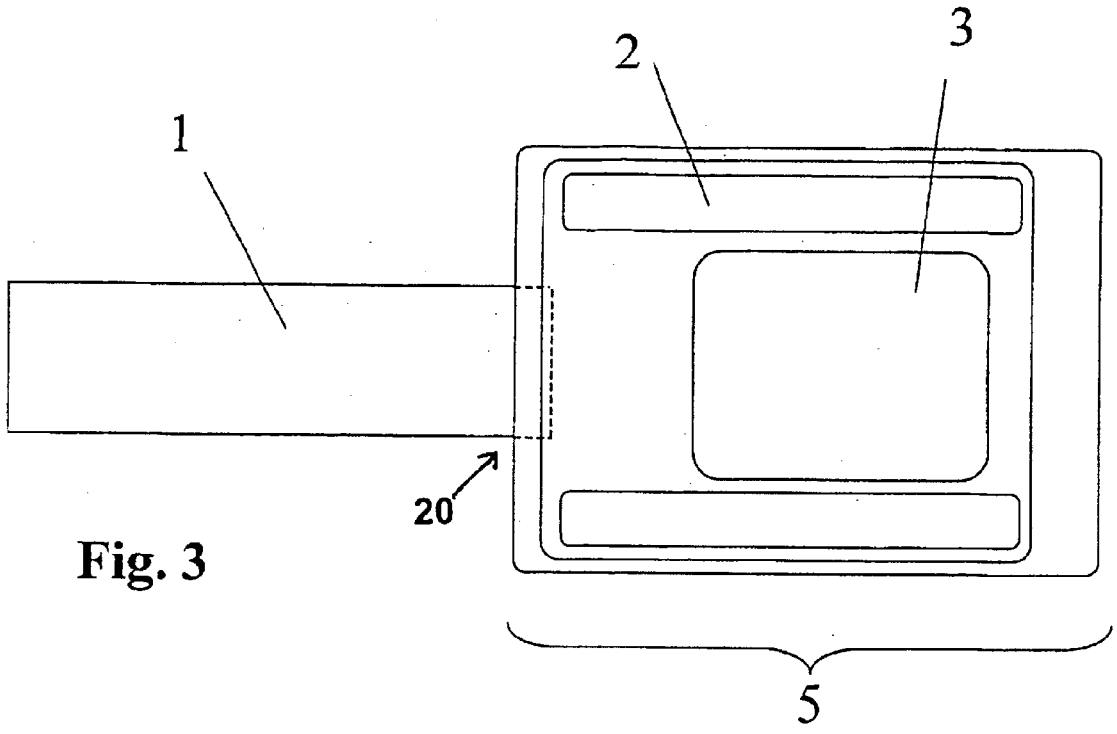
FIG. 3 shows a bottom view of the flat end head.
Figure 4:
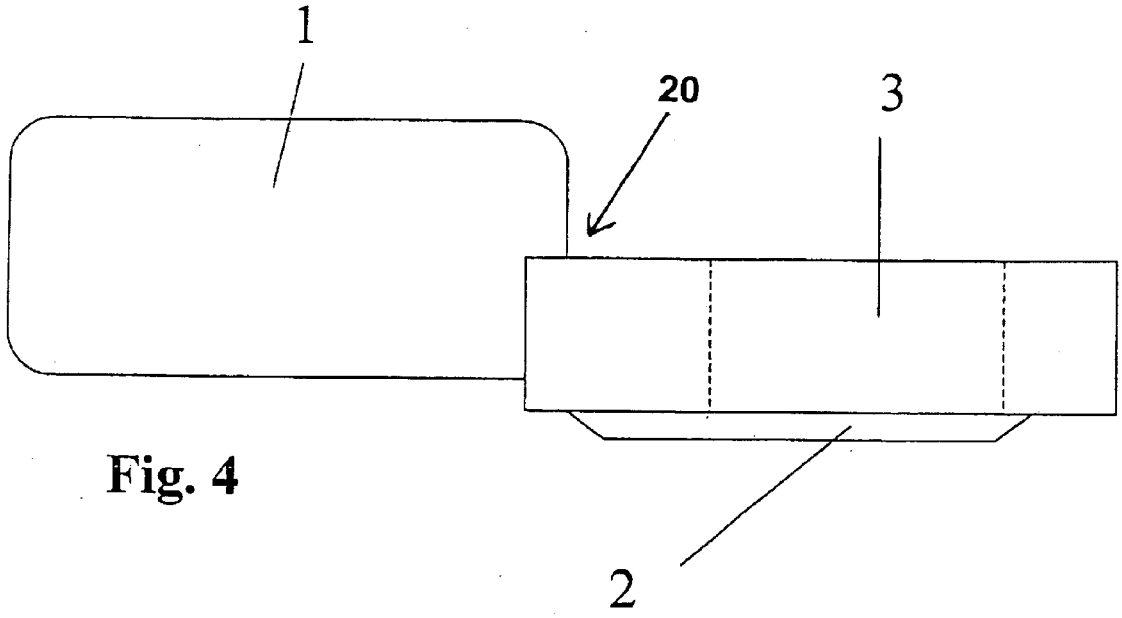
FIG. 4 shows a side view of the flat end head.

FIGS. 3 and 4 show the flat end head (20) in detail. Preferably, the flat end head (20) can be made a one-piece part. The flat end (20) includes multiple sections. The first section (1) is responsible for the mounting with the flat rod. The second section includes the actual head (5) which rests on the sliding guide and which is additionally provided with respective sliding surfaces (2). One of the two sections could also be furnished additionally with a provision for the mounting of the endless component, for example a recess (3) within the actual head (5).

Figure 5:
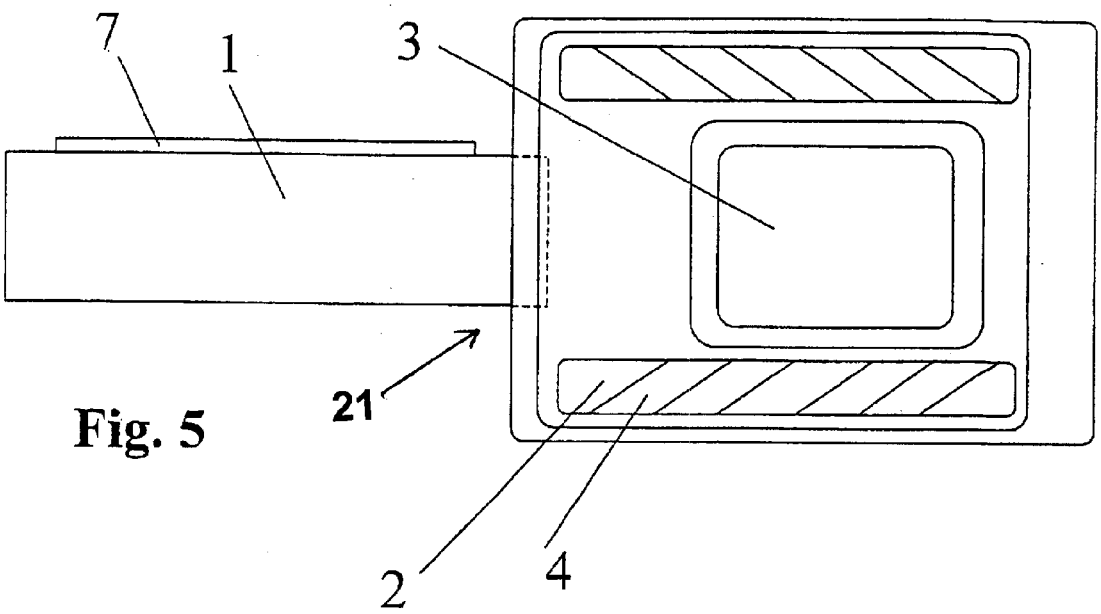
FIG. 5 shows a bottom view of the flat end head with grooves for the removal of dirt.
Figure 6:
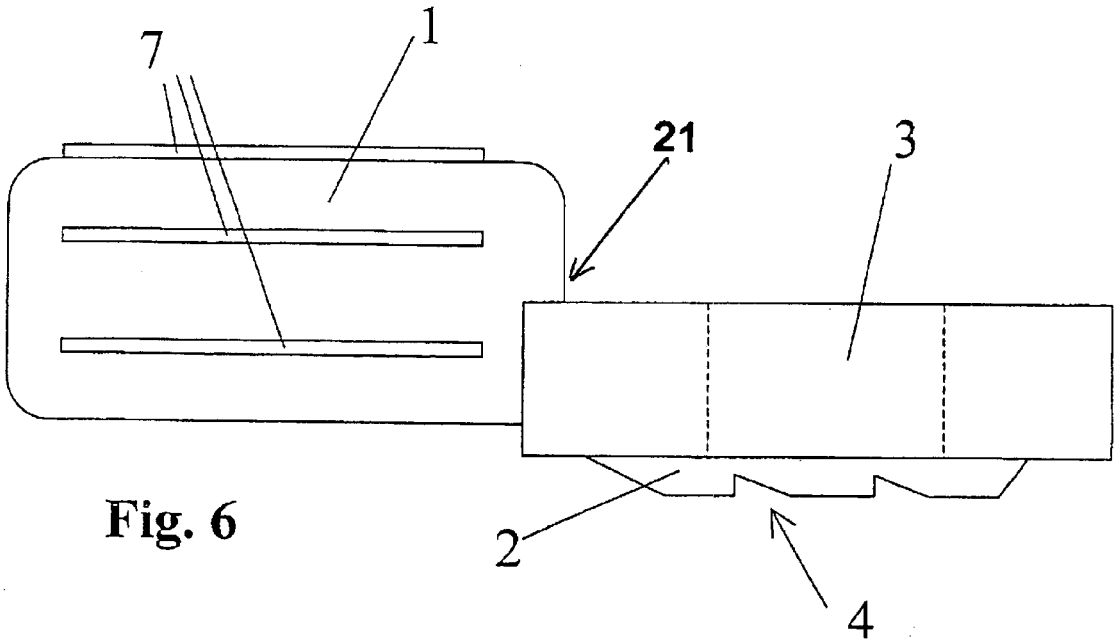
FIG. 6 shows a side view of a flat end head with grooves for the removal of dirt.

FIGS. 5 and 6 show similar flat end heads (21) as FIGS. 3 and 4. In this example, it is suggested to have the sliding surfaces, favourably and according to the invention, furnished with at least one, preferably several cleaning slots (4). These cleaning slots have the task of removing or collecting contaminations which were deposited on the sliding surface. The cleaning slots (4) should be inclined in relation to the direction of travel, preferably at about an angle of 30°. The cleaning slots (4) also are dimensioned with a sufficient depth so that they can take up all contaminations until they are brushed during the cleaning of the flat.

The cleaning slots (4) in addition are provided with a sufficient depth, whereby sand grains or other contaminations do not have any further contact with the mating surface, i.e. the sliding guide. Thus, it is possible to remove the contaminations without damaging or scratching the sliding guide or the sliding surface (2) of the flat end head (21). Thus, an even surface of the sliding guide is ensured and, as a consequence, an even wear of the sliding surface. For a firm positioning of the flat head (21) within the flat rod according to the invention, a profile (7) can be attached on the mounting element (1) of the flat end head (21), for example raised longitudinal strips on at least one longitudinal side, (see FIGS. 4 and 5, (7)). This profile (7) has the function to neutralize inaccuracies within the hollow profile of the flat rod through counter pressure and increase of the clamping force of the flat end head (21) within the flat rod.

Figure 7:
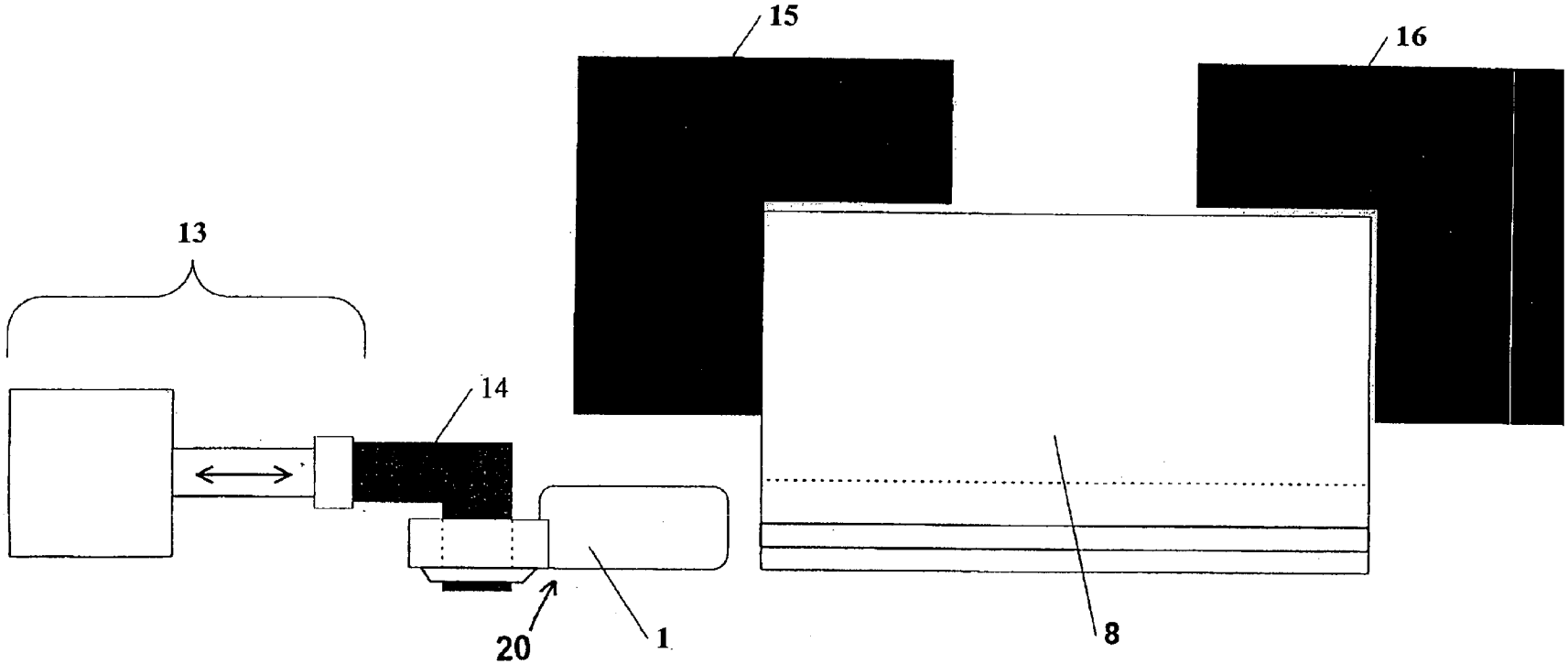
FIG. 7 shows a method and a device to exchange the flat end heads.

FIG. 7 shows schematically (not to scale) a device for the replacement of the flat end head. This device includes:

- stop blocks (15 or 16), whose function it is to hold the flat rod in its position during the disconnection or the mounting of the flat end head;
- means with which the flat end head (20) can be secured, for example, a holder (14) which fits into the recess (FIG. 1, (3)) serving both for the mounting and for the dismounting of the flat end head (20); and
- a piston, or a cylinder, unit (13) which generates a force in the required direction, while one of the stop blocks ((15) for the dismounting and (16) for the mounting) is provided to generate a counter acting force.

According to the invention at least one stop block is being required.

Dismounting is brought about by the piston unit (13) moving away from the flat rod in longitudinal direction, whereby the holder (14) secures the flat end head (20) and pulls it out of the hollow profile of the flat rod (8). In order to ensure that the flat rod (8) is not also pulled along with the flat end head (20), a stop block (15) restricts the path.

Mounting is brought about by the piston unit (13) with the new flat end head secured via the holder (14) moving towards the flat rod (8) and thus pressing the flat end head into the hollow profile of the flat rod up to the stop. The stop block (16) in this case prevents the flat rod (8) from being pushed away. According to the invention, rounding of the edges and chamfering of the mounting element (1) of the flat end head can simplify this process.

The flat end head (20, 21) is made of a polymer material. The flat end head (20, 21) can be manufactured by way of an injection molding technique. In some embodiments, the polymer material may be selected from a material of the group of the polyamides, such as polyamide 66. In other embodiments, the polymer material can be a polyoxymethylene. Further, the polymer can be a terephthalate in other embodiments. In particular, this polymer material can be preferably a polyethylene terephthalate or polybutylenterephthalate in such embodiments. The polymer material may also be a polyetheretherketone. In further embodiments, the polymer material may be a polyimide, for example, a polyamidimide.

It is also advantageous if the polymer material that forms the flat end head (20, 21) includes a solid lubricant. The solid lubricant may be polytetrafluorethylene, graphite, polyethylene, molybdenum disulphide, or polysiloxan. A chart showing the preferred combinations of base polymer and solid lubricant is included in the Objects and Summary of the Invention section, and one should be referred to it to identify each preferred combination. The amount of solid lubricant that is included in the polymer material should makeup about 1 to 15 percent of the weight of the flat end head (20, 21). Preferably, the amount of solid lubricant amounts to about 5 to 12 percent of the weight when polytetrafluorethylene, graphite or polyethylene is used. In particular, the amount of solid lubricant is about 8 to 11 percent of the weight when polytetrafluorethylene, graphite or polyethylene is used. However, it is preferable for the amount of solid lubricant to be about 1 to 3 percent of the weight of the combination when polysiloxan or molybdenum disulphide is used.

The polymer material can be fiber-reinforced. At least one of either carbon fibers or aramid fibers can be used for the fiber-reinforcement. If a fiber mixture is used, the portion of aramid fibers should amount to at least 10 percent of the weight of such fiber mixture. The fiber reinforcement can makeup about 5 to 60 percent of the weight of the polymer and fiber mixture comprising the flat end head (20, 21). Preferably, the fiber reinforcement can be about 30 to 50 percent of the weight of the polymer and fiber mixture.

Further, it is advantageous to have the sliding guide (6) of the card to be made of a polymer material of the kind described above. In such embodiments, the polymer material of the sliding guide (6) may include a solid lubricant as described.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A flat end head attachable to an end of a flat rod of a card used in yarn preparation, said flat end head comprising:

- a mounting element attachable to one of said flat rods of said card;
- a head integral to said mounting element, said head extendable from said flat rod proximal to a sliding guide of said card;
- a sliding surface integral to said head, said sliding surface slidingly contactable with said sliding guide of said card to facilitate movement of said flat rod in relation to said card; and
- wherein said flat end head, including said integrated mounting element, head and sliding surface, is constructed from a polymer material.

2. A flat end head as in claim 1, wherein said mounting element is insertable into said flat rod.

3. A flat end head as in claim 2, wherein said mounting element has rounded edges on an end that is insertable into said flat rod.

4. A flat end head as in claim 1, further comprising elevated profiles operably disposed on said mounting element.

5. A flat end head as in claim 1, wherein said sliding surface forms at least one cleaning slot.

6. A flat end head as in claim 1, wherein said polymer material is a polyamide.

7. A flat end head as in claim 1, wherein said polymer material is a polyoxymethylene.

8. A flat end head as in claim 1, wherein said polymer material is a terephthalate.

9. A flat end head as in claim 8, wherein said polymer material is a polyethylene terephthalate or polybutylenterephthalate.

10. A flat end head as in claim 1, wherein said polymer material is a polyetheretherketone.

11. A flat end head as in claim 1, wherein said polymer material is a polyimide.

12. A flat end head as in claim 11, wherein said polymer material is a polyamidimide.

13. A flat end head as in claim 1, wherein fibers are included in said polymer material to create a polymer and fiber mixture that forms said flat end head.

14. A flat end head as in claim 13, wherein said fibers are at least one of carbon fibers or aramid fibers.

15. A flat end head as in claim 1, wherein said polymer material includes a solid lubricant.

16. A flat end head as in claim 15, wherein said solid lubricant is at least one of a polytetrafluorethylene, a graphite, a polyethylene, a molybdenum disulphide or a polysiloxan.

17. A flat end head as in claim 1, wherein said flat end head is formed by injecting said polymer material into a mold.

18. A flat end head attachable to an end of a flat rod of a card used in yarn preparation, said flat end head comprising:

a mounting element attachable to one of said flat rods of said card;

a head integral to said mounting element, said head extendable from said flat rod proximal to a sliding guide of said card;

a sliding surface disposed on said head, said sliding surface slidingly contactable with said sliding guide of said card to facilitate movement of said flat rod in relation to said card;

wherein said flat end head is constructed from a polymer material; and wherein said mounting element, said head, and said sliding surface are formed from a unitary piece of said polymer material.

19. A flat end head attachable to an end of a flat rod of a card used in yarn preparation, said flat end head comprising:

a mounting element attachable to one of said flat rods of said card;

a head integral to said mounting element, said head extendable from said flat rod proximal to a sliding guide of said card;

a sliding surface disposed on said head, said sliding surface slidingly contactable with said sliding guide of said card to facilitate movement of said flat rod in relation to said card and said sliding surface forming at least one cleaning slot;

wherein said flat end head is constructed from a polymer material; and wherein said at least one cleaning slot formed by said sliding surface is inclined in relation to the direction of travel of said flat rod.

20. A flat end head as in claim 19, wherein said at least one cleaning slot formed by said sliding surface is inclined at about an angle of 30°.

21. A flat end head attachable to an end of a flat rod of a card used in yarn preparation, said flat end head comprising:

a mounting element attachable to one of said flat rods of said card;

a head integral to said mounting element, said head extendable from said flat rod proximal to a sliding guide of said card;

a sliding surface disposed on said head, said sliding surface slidingly contactable with said sliding guide of said card to facilitate movement of said flat rod in relation to said card; and wherein said flat end head is constructed from a polymer and fiber mixture, whereby said fibers are a mixture of carbon fibers and aramid fibers and said mixture of said fibers include an amount of said aramid fibers, which constitutes at least 10 percent of the weight of said fiber mixture.

22. A flat end head attachable to an end of a flat rod of a card used in yarn preparation, said flat end head comprising:

a mounting element attachable to one of said flat rods of said card;

a head integral to said mounting element, said head extendable from said flat rod proximal to a sliding guide of said card;

a sliding surface disposed on said head, said sliding surface slidingly contactable with said sliding guide of said card to facilitate movement of said flat rod in relation to said card; and wherein said flat end head is constructed from a polymer and fiber mixture material and said fibers constitute about 5 to 60 percent of the weight of said polymer and fiber mixture.

23. A flat end head as in claim 22, wherein said fibers constitute about 30 to 50 percent of the weight of said polymer and fiber mixture.

24. A flat end head attachable to an end of a flat rod of a card used in yarn preparation, said flat end head comprising:

a mounting element attachable to one of said flat rods of said card;

a head integral to said mounting element, said head extendable from said flat rod proximal to a sliding guide of said card;

a sliding surface disposed on said head, said sliding surface slidingly contactable with said sliding guide of said card to facilitate movement of said flat rod in relation to said card;

wherein said flat end head is constructed from a polymer material that includes a solid lubricant that is at least one of a polytetrafluorethylene, a graphite, a polyethylene, a molybdenum disulphide or a polysiloxan; and wherein said solid lubricant is about 1 to 15 percent of the weight of said polymer material.

25. A flat end head as in claim 24, wherein said solid lubricant is at least one of said polytetrafluorethylene, said graphite, or said polyethylene and is about 5 to 12 percent of the weight of said polymer material.

26. A flat end head as in claim 24, wherein said solid lubricant is at least one of said molybdenum disulphide or said polysiloxan and is about 1 to 3 percent of the weight of said polymer material.

27. A card for straightening and aligning fibers, said card comprising:

a rotatable cylinder having a clothing disposed on an outer circumference;

a plurality of flat rods carried on said card and movably proximal to said cylinder, each of said flat rods extendable across a width of said cylinder and having a clothing that operably interacts with said clothing of said cylinder;

at least two sliding guides carried on opposite sides of said cylinder, said at least two sliding guides supporting said plurality of flat rods as said clothing operably interact with said clothing of said cylinder;

at least two flat end heads disposable on each of said flat rods, each of said flat end heads having a mounting element integral to a head and an integral sliding surface slidingly contactable with at least one of said sliding guides to support each of said flat rods and facilitate movement of each of said flat rods in relation to said cylinder; and said flat end head including said mounting element, head, and integral sliding surface is constructed from a first polymer material.

28. A card as in claim 27, wherein said sliding surface forms at least one cleaning slot.

29. A card as in claim 27, wherein fibers for reinforcement are included in said first polymer material to create a polymer and fiber mixture that forms said flat end head.

30. A card as in claim 27, wherein said first polymer material includes a solid lubricant.

31. A card as in claim 27, wherein said at least two sliding guides is constructed of a second polymer material.

32. A card as in claim 31, wherein said second polymer material and said first polymer material are the same.

33. A card as in claim 31, wherein fibers are included in said second polymer material to create a polymer and fiber mixture that forms said at least two sliding guides.

34. A card as in claim 31, wherein said second polymer material includes a solid lubricant.

* * * * *